United States Patent [19]

Ono et al.

[11] Patent Number: 4,703,293

[45] Date of Patent: Oct. 27, 1987

[54] POLARIZED ELECTROMAGNETIC ACTUATOR DEVICE

[75] Inventors: Kenji Ono; Kazuhiro Nobutoki, both of Matsusaka, Japan

[73] Assignee: Matsushita Electric Works, Ltd., Japan

[21] Appl. No.: 836,734

[22] Filed: Mar. 6, 1986

[30] Foreign Application Priority Data

Mar. 25, 1985 [JP] Japan ..... 60-60093

[51] Int. Cl.[4] ..... H01H 51/22

[52] U.S. Cl. ..... 335/80; 335/81; 335/230; 335/236

[58] Field of Search ..... 335/78, 80, 81, 84, 335/85, 229, 230, 236

[56] References Cited

U.S. PATENT DOCUMENTS

| | | | |
|---|---|---|---|
| 4,064,471 | 12/1977 | Schuessler | 335/229 |
| 4,134,090 | 1/1979 | Schuessler et al. | 335/229 |
| 4,160,965 | 7/1979 | Kobler | 335/230 |
| 4,182,998 | 1/1980 | Mueller | 335/151 |
| 4,286,244 | 8/1981 | Schuessler et al. | 335/230 |
| 4,551,698 | 11/1985 | Aidn | 335/78 |

FOREIGN PATENT DOCUMENTS 2148377 10/1971 Fed. Rep. of Germany .

*Primary Examiner*—Clifford C. Shaw
*Assistant Examiner*—Lincoln Donovan
*Attorney, Agent, or Firm*—Stevens, Davis, Miller & Mosher

[57] ABSTRACT

A polarized electromagnetic actuator device advantageous for single-stable armature operation comprises an armature pivotally supported for movement between two different angularly displaced positions about a pivot axis and an electromagnet with a pair of opposed pole members extending toward the ends of the armature on either side of the pivot axis. Disposed between the free ends of the opposite pole members is a bar-shaped three-pole magnetized permanent magnet which is magnetized to have end poles of the same polarity at the longitudinal ends and a center pole of the opposite polarity intermediate the ends, producing first and second flux paths opposing to each other and extending between the respective end portions of the permanent magnet and the adjacent end portions of the armature. The center pole is offset from the pivot axis of the armature to provide at a correspondingly offset portion therefrom between the armature and the permanent magnet a common flux path through which the first and second flux paths extend in the same direction, whereby producing a torque on the armature tending it to rotate about the pivot axis toward the one of the two angularly displaced positions.

3 Claims, 12 Drawing Figures

POLARIZED ELECTROMAGNETIC ACTUATOR DEVICE

BACKGROUND OF THE INVENTION

1. Field of the Invention

The present invention relates to a polarized electromagnetic actuator device, and more particularly to such a device advantageous for operating relay contacts in a single-stable manner.

2. Description of the Prior Art

Prior polarized electromagnetic actuators for relays are known such as disclosed in U.S. Pat. Nos. 4,064,471 and 4,134,090 and in German Patent Publication (Auslegeschrift) No. 2,148,377, in which a permanent magnet is combined with an electromagnet to provide a magnetic system utilized for obtaining a single-stable relay operation. As shown in FIG. 1 of the attached drawing of the present invention which is a greatly schematic representation of the prior magnetic system, the prior devices include a slightly V-shaped armature 6 carrying one or more movable contacts and pivotally supported for angular movement in relation to the electromagnet 1 with a yoke 2 and an exciter coil 5. The permanent magnet 7, which is incorporated for the purpose of biasing the armature 6 to a reset position and holding the same in the position, is coupled to the electromagnet 1 with its one pole end connected to one of the yoke legs 3 and with other pole end away from the other yoke leg 4 but in closely adjacent relation to the pivot axis of the armature 6. The permanent magnet 7 thus incorporated forms two separate magnetic flux paths, one being a reset flux path circulating from the permanent magnet 7 and extending only through one end portion of the armature 6 as indicated by a line A with arrows and the other being a set flux path circulating from the same and extending through the entire length of the yoke 2 as indicated by a line B with arrows of the figure. In this way, the reset flux path A is made far shorter than the set flux path B by the length of the yoke 2 to thereby exert a magnetomotive force stronger than the set flux path, magnetically biasing the armature 6 to the reset position. That is, the prior devices depend upon the difference in the length or the magnetic resistance between the first and second flux paths A and B for biasing the armature to the reset position. However, such difference is closely related to the configurations of the components constructing the device and is therefore susceptible to dimensional variations thereof, making it rather difficult to provide the device of consistent magnetic characteristics. This is most disadvantageous in designing the relay of single-stable operation by combining the device with suitable return spring means biasing the armature from the set position to the reset position. The above problem is especially serious when the actuator device or the relay assembled therefrom is needed for miniaturization where the armature is driven to move between the set and, reset positions by a delicate difference in the combination forces applied thereto from the magnetic circuit and the return spring means.

SUMMARY OF THE INVENTION

The present invention has been accomplished in view of the above and provides an electromagnetic actuator device of unique magnetic circuit advantageous for obtaining a single-stable armature operation. The actuator device in accordance with the present invention comprises an armature pivotally supported for movement about a pivot axis, and an electromagnet having a core, an exciter coil wound on the core, and a pair of pole members extending from the ends of the core toward the ends of the armature on either side of the pivot axis. A bar-shaped three-pole magnetized permanent magnet is disposed between the free ends of the pole members in generally parallel relation to the armature. Said permanent magnet is magnetized to have end poles of the same polarity at its lengthwise ends and have a center pole of the opposite polarity intermediate its end so as to produce with the armature first and second flux paths opposing to each other, said first flux path circulating between the center pole and one of the end poles through one end portion of the permanent magnet and the adjacent end portion of the armature and said second flux path circulating between the center pole and the other end pole through the other end portion of the permanent magnet and the adjacent end portion of the armature.

The characteristic feature of the present invention resides in that the permanent magnet is magnetized to have its center pole offset from the pivot axis of the armature along the length of the permanent magnet. With this offset magnetization of the permanent magnet, the opposing first and second flux paths can have a common air gap between the permanent magnet and the armature at a location correspondingly offset from the pivot axis. It is at this air gap offset from the pivot axis where the first and second flux path extends in the same direction to develop an added magnetomotive force for producing a torque on the armature rotating it about the pivot axis in the one direction, or toward the one of the angularly displaced positions upon de-energization of the permanent magnet. In this way, the armature is magnetically unbalanced about its pivot axis tending to rotate toward the one of its two different angularly displaced positions by the offset magnetization of the permanent magnet without depending upon the difference in the magnetic resistance between the first and second flux paths, enabling it to provide a magnetic system of consistent magnetic characteristics substantially free from dimensional variations in the components employed. Such consistent magnetic characteristics can facilitate designing of single-stable type relays and therefore gives rise to reliable and accurate single-stable relay operation.

Accordingly, it is a primary object of the present invention to provide a polarized electromagnetic actuator device which provides consistent magnetic characteristics advantageous for obtaining relays of reliable single-stable operation.

In a preferred embodiment, the permanent magnet is formed on its end half portions respectively with oppositely inclined surfaces confronting the armature, so that the permanent magnet is closer to the armature at its center than at the longitudinal ends when the armature is in a neutral position between two angularly displaced positions where the armature has its end evenly spaced from the corresponding pole members. The inclined surface on each end half portion of the permanent magnet is advantageous in that the armature in either of two angularly displaced positions can have its one end half portion brought into parallel relation to the adjacent inclined surface so as to be equally closed at its end to the inclined surface, eliminating the magnetic loss in the paths circulating the permanent magnet and the armature and thereby exerting maximum magnetomotive forces between the armature and the permanent magnet at a minimum magnetic power of the permanent magnet, which is most suitable for obtaining an increased contact pressure with a limited size of the permanent magnet in the case of the present device being utilized in relays for actuating the relay contacts.

It is therefore another object of the present invention to provide a polarized electromagnetic actuator device in which the armature forms with the permanent magnet effective magnetic system for actuation of the armature.

Said three-pole magnetized permanent magnet is made of a magnetic material essentially composed of Fe-Cr-Co alloy material. Such magnetic material is known to have higher recoil permeability [$\mu_r$] in its anisotropic direction as well as in a direction perpendicular thereto, which is most suitable for effectively magnetizing this particular type of three-pole permanent magnet as well as for effectively exerting its magnetomotive force in the armature operation.

Also, the material can be subjected to a roll forming so that it can be easily shaped into any advantageous configuration in designing an effective magnetic system including the above configuration having the oppositely inclined surface on each end half portion of the permanent magnet.

It is therefore a further object to provide a polarized electromagnetic actuator device which incorporates the permanent magnet of superior magnetic characteristics most suitable for the armature operation.

These and still other objects and advantageous features will become more apparent from the following description of a preferred embodiment of the present invention when taken in conjunction with the accompanying drawings.

DESCRIPTION OF THE PREFERRED EMBODIMENT

Figure 1:
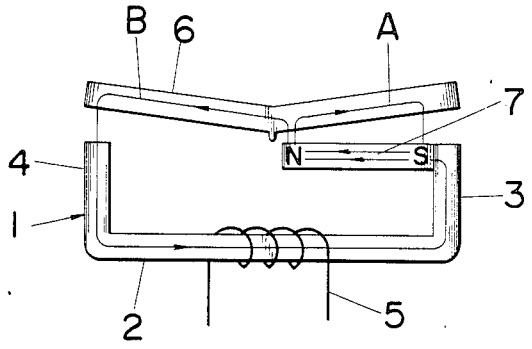
Fig. 1 (PRIOR ART)
FIG. 1 is a greatly highly schematic view of a prior art polarized electromagnetic actuator device.
Figure 2:
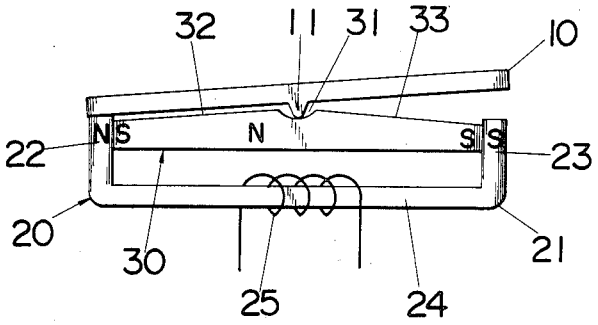
FIG. 2 is a schematic view of a polarized electromagnetic actuator device in accordance with the present invention.

Referring now to FIG. 2, there is shown a polarized electromagnetic actuator device embodying the present invention. The actuator device comprises a flat-shaped armature 10 pivoted at its center for angular movement about a center pivot axis, an electromagnet 20, and a bar-shaped three-pole magnetized permanent magnet 30 integrated into the electromagnet 20. The electromagnet 20 has a U-shaped yoke 21 with a pair of parallel pole members or legs 22 and 23 connected by a core 24, an exciter coil 25 wound around the core 24. Said permanent magnet 30 extends in generally parallel relation to the armature 10 between the upper ends of the pole members 22 and 23 with the center of its length in register with the pivot axis of the armature 10, and is magnetized to have end poles of the same polarity, for example south poles S, at its ends and a center pole of the opposite polarity, or north pole N intermediate the ends. Formed in the upper surface of the permanent magnet 30 is a round groove 31 in which is seated a center projection 11 on the underside of the armature 10 for supporting the armature 10 on the permanent magnet 30. The permanent magnet 30 is made of magnetic material such as Fe-Cr-Co alloy having a higher recoil permeability [$\mu_r$] in its anisotropic direction as well as in a direction perpendicular thereto, permitting easy magnetization for this particular type of three-pole magnet and formation of efficient magnetic circuits with the armature 10 due to its higher magnetomotive force developed in the direction of the length of the permanent magnet 30 as well as in the direction perpendicular thereto.

Figure 3:
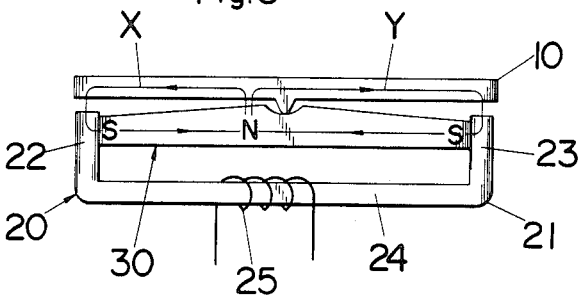
FIG. 3 is an explanatory view of the above actuator device with the armature in a neutral position.

The armature 10 is pivotable about its center axis for movement between two angularly displaced positions at each of which the armature 10 has its one end moved to the upper end of the adjacent pole member 22, 23 and has the other end moved away from the upper end of the adjacent pole members 23, 22. The three-pole permanent magnet 30 is cooperative with the armature 10 to form opposing first and second flux paths respectively indicated by lines X and Y in FIGS. 3, 5 and 6, said first flux X circulating between the center pole and one of the end poles through an end portion of the permanent magnet 30 and the adjacent end portion of the armature 10 and the second flux path Y circulating through the other end portion of the permanent magnet 30 and the adjacent end portion of the armature 10. Formed between the permanent magnet 30 and the armature 10 at a location corresponding to the center pole is a common air gap through which the first and second flux paths extends in the same direction so as to be additive with each other.

Figure 4:
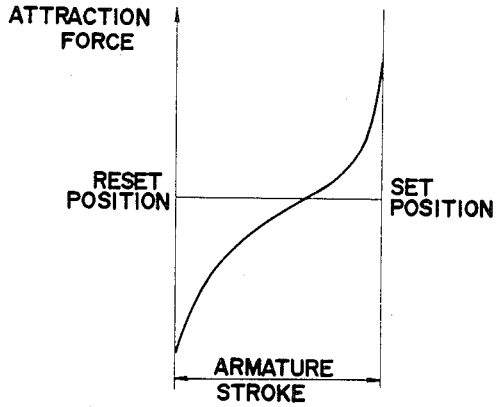
FIG. 4 is a graphical representation of the force acting upon the armature from the permanent magnet of the present device.

The permanent magnet 30 is magnetized in such a way as to have the center pole, or north pole N at a position offset from its center, i.e., the pivot axis of the armature 10 toward the right hand end bearing south pole S so that the above common air gap is correspondingly offset to the left from the pivot axis of the armature 10 but adjacent thereto, whereby producing at this offset common air gap a torque on the armature 10 tending it to rotate in the counter-clockwise direction or magnetically biasing it to the one of the two angular displaced positions where the left hand end of the armature 10 is attracted to the adjacent pole member 22 when the electromagnet 20 is de-energized. With this result, the armature 10 is magnetically unbalanced about the pivot axis to be constantly biased in one direction, such unbalanced magnetomotive forces acting on the armature 10 on the opposite side of the pivot axis are understood from FIG. 4 in which is shown as a function of the armature stroke between reset and set positions a force acting on the armature 10 at a portion spaced from the pivot axis by the permanent magnet 30 alone.

The electromagnetic actuator device thus constructed is combined with suitable mechanical return spring means (not shown in FIGS. 2, 3, 5 and 6) coupled to the armature 10 for establishing a single-stable armature operation. The mechanical spring means may be of conventional design to evenly load the armature 10 in the opposite directions about the pivot axis.

Figure 5:
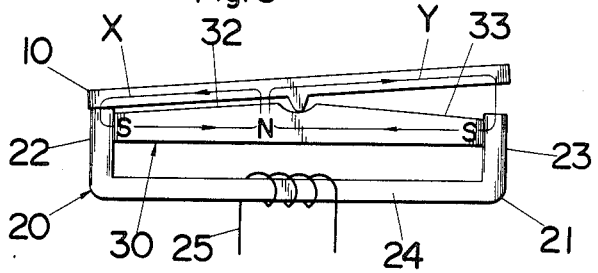
FIGS. 5 and 6 are explanatory views respectively showing the armature of the above device in its reset and set positions.
Figure 6:
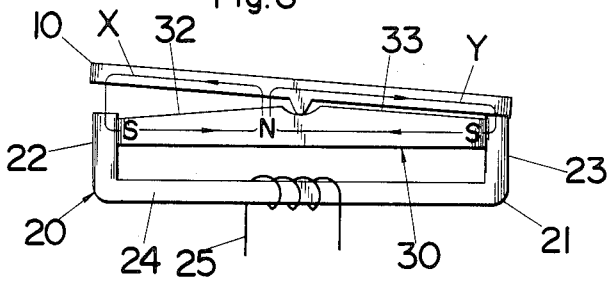
Figure 7:
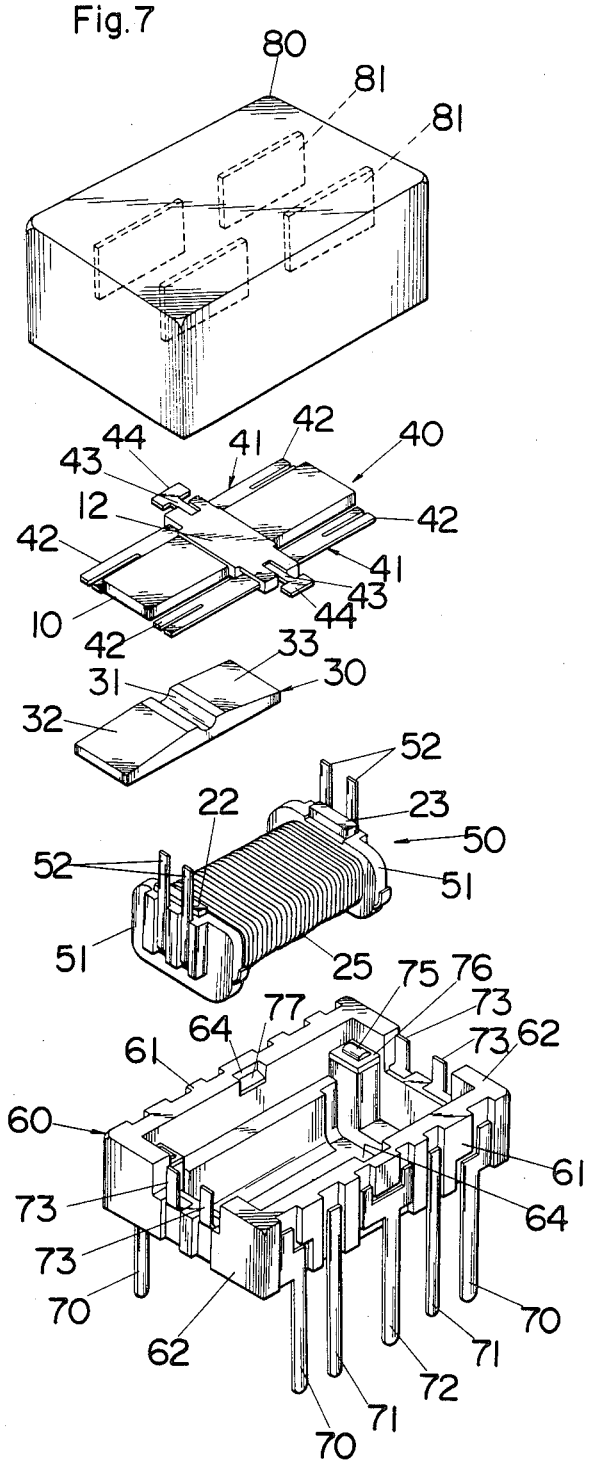
FIG. 7 is an exploded perspective view of a polarized electromagnetic relay to which the present device is adapted.

In operation, upon de-energization of the electromagnet 20 the magnetomotive forces developed between the permanent magnet 30 and the armature 10 respectively at the left hand end of the armature 10 and at the common air gap, both on the same side of the pivot axis, are additive to produce a strong torque on the armature 10 rotating it about the pivot axis against the bias of the spring means into a reset position of FIG. 5 and is held at this reset position by the magnetomotive force due to the first flux path X. For moving the armature 10 to the set position, the electromagnet 20 is energized in such a direction as to add a resulting strong flux path to the second flux path Y, in this instance, to produce a south pole S at the right hand pole member 23. Consequently, the added magnetomotive forces from the second flux path Y and that of the electromagnet 20 cause the armature 10 to move against the bias of the spring means into a set position of FIG. 6 as canceling the magnetomotive force by the first flux path X. When the electromagnet 20 is de-energized with the armature 10 in its set position of FIG. 6, the force developed at the common air gap is subtractive to the forces developed between the right hand end of the armature 10 and the adjacent pole member 23 at the opposite side of the pivot axis from the common air gap so that the armature 10 can be moved back with the assistance of the spring means to the reset position of FIG. 5 and is kept latched thereat until the electromagnet 20 is again energized. More precisely, upon de-energization of the electromagnet 20, the restoring force of the spring means is additive to force developed at the common air gap so as to move back the armature 10 to the neutral position from the set position of FIG. 6 against the force from the second flux path Y, after which the armature 10 is attracted to the reset position of FIG. 5 against the bias of the spring means now acting in the opposite direction. In this sense, the electromagnetic actuator device of the present invention can be readily combined with the spring means evenly biasing the armature 10 in the opposite direction about the pivot axis in order to obtain a single-stable armature operation.

The upper face of the permanent magnet 30 confronting the armature 10 is configured to have on its end half portions oppositely inclined surfaces 32 and 33 extending downwardly outwardly from its center to its ends. With the provision of the inclined surfaces 32 and 33, the armature 10 either in the reset or set position can have its end half portion be kept in parallel relation with the adjacent inclined surface 32, 33 so that each end half portion of the armature 10 can be substantially equally closed at its ends to the permanent magnet 10 to thereby reduce the magnetic loss in either the first or second flux paths as much as possible, giving rise to increased efficiency of the magnetic circuits.

Figure 8:
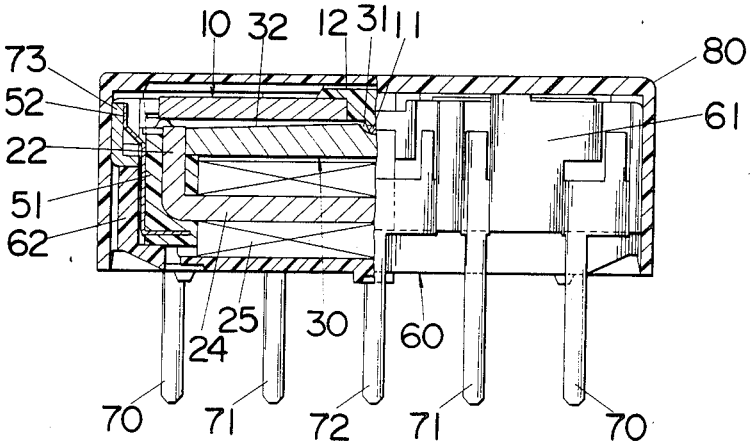
FIG. 8 is a front view partly in cross section of the above relay.

Referring now to FIGS. 7 to 11, there is shown a polarized electromagnetic miniature relay of single-stable operation as one typical example to which the actuator device of the present invention is adapted. The relay has a double-pole double-throw contact arrangement and includes a pair of movable common contact springs 41 each having two contact ends at 42 in alternate contact with complementary fixed contacts 75. Said movable common contact springs 41 extend along the lateral sides of the armature 10 within the plane thereof and are integrally but insulatively connected by a molding 12 to the armature 10 to provide a one-piece armature unit 40 having the armature 10 and the contact springs 41. Said electromagnet 20 and permanent magnet 30 are assembled also into a one-piece coil unit 50 provided with end flanges 51 of plastic material each carrying a pair of upwardly extending conductors 52 electrically coupled at the lower ends to the respective exciter coil 25 included in the unit 50. Said pole members 22 and 23 of the electromagnet 20 extend upwardly through the end flanges 51 to form pole faces at the respective upper ends thereof for magnetic coupling with the armature 10. The permanent magnet 30 extends between the exposed upper ends of the pole members 22 and 23 to be fixed thereto, as shown in FIG. 8.

The armature and coil units 40 and 50 are received in a casing 60 which is molded from a plastic material into a top-opened rectangular shallow box enclosed by side walls 61 and end walls 62. A plurality of terminal pins 70, 71 and 72 extend outwardly of the casing 60 with its portions molded in the side and end walls of the casing 60. Such terminal pins 70, 71 and 72 are formed respectively with integral extensions which extend through the side and end walls 61 and 62, as shown by dot lines in FIG. 9, to reinforce the casing 60 and define at the inward end separate elements respectively for electrical connection with the electromagnet 20 and the movable contact springs 41. Said terminal pins 70, 71 and 72 are bent at a right angle to the plane of the casing 60 after being molded to extend downwardly thereof.

Each pair of conductors 52 on the coil unit 50 are connected to corresponding pair of tabs 73 on each end wall 62 by staking, brazing or other conventional manner, the tabs 73 being integrally connected to the respective terminal pins 70 through said extensions molded in the end wall 62. It is to be noted at this time that said coil unit 50 includes a pair of exciter coils each coupled to each pair of the conductors 52 and utilized to be energized by a control current of opposite polarity. The inclusion of two coils is merely for an economical reason that the coil unit 50 can be utilized as a common component to relays of bistable operation requiring set and rest coils, which relays of bistable operation can be made to be similar in construction to the present relay except that a permanent magnet having the opposite pole at exact center of its length. Thus, in the present relay of single-stable operation only one of the exciter coils is utilized for energization of the electromagnet 20. That is, only one pair of the terminal pins 70 leading to the single coil are utilized for the desired relay operation.

Two sets of said fixed contacts 75 are formed on separate carrier plates 76 supported at the inside corners of the casing 60 and connected integrally to the corresponding terminal pins 71 through the extensions embeded in the side walls 61. Formed in the upper and inner end of each side wall 61 at the center of its length is a cavity 64 within which is seated a contact piece 77 for electrical connection with each of said movable common contact springs 41, said contact piece 77 being formed as an integral part of said extension leading through the side wall 61 to the corresponding terminal pin 72.

Each of said movable common contact springs 41 is in the form of an elongate leaf spring having its contact ends 42 bifurcated to add increased flexibility thereto. Formed integrally with each contact spring 41 is a pivot arm 43 with an enlarged flap 44 which extends outwardly from the center of its length at a right angle with respect to the lengthwise axis thereof. These pivot arms 43 are in alignment with said projection 11 on the underside of the armature 10, the projection 11 being integral with the molding 12 and being rotatably received in said groove 31 for supporting the armature 10 on the permanent magnet 30.

Figure 11:
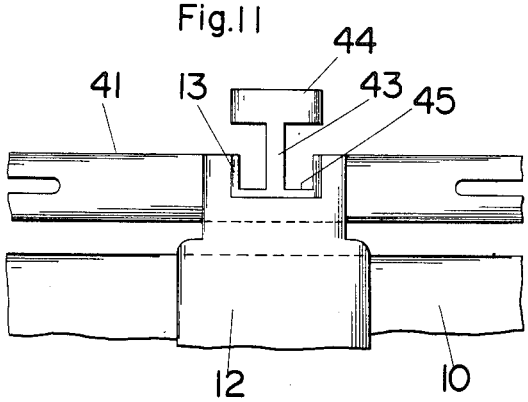
FIG. 11 is a fragmentary plan view of the armature unit.

The contact springs 41 are embeded at their center portions into the ends of said molding 12 extending transversely of the armature 10 so as to be integrally supported thereby. As best shown in FIG. 11, the pivot arm 43 extends from the bottom of a notched portion 45 in the center of the spring 41 and has a narrower width than the rest of the contact spring 41, the entire pivot arm 43 and the substantial area of the notched portion 45 being exposed within a corresponding recess 13 in the end of the molding 12. It is by the pivot arms 43 that the armature 10 is pivotally supported to the casing 60 for effectuating the contacting operation upon energization and de-energization of the electromagnet 20. That is, the armature unit 40 is assembled into the relay with the flaps 44 at the free ends of the pivot arms 43 being fixedly fitted within said cavities 64 in the upper end of the side walls 61 and can pivot about the axis of the pivot arms 43 as elastically deforming the pivot arms 43 about its axis.

In this sense, each of the pivot arms 43 having the narrower width defines themselves a resilient torsion elements of limited deformability whereby the armature 10 is permitted to pivot about the axis within a limited angular movement. It should be noted at this time that the pivot arms 43 serving as the resilient torsion elements constitute together with the movable contact springs 41 said mechanical spring means which biases the armature 10 to its neutral position either from set or reset, as mentioned previously with reference to FIGS. 3, 5 and 6.

When the armature unit 40 is assembled into the casing 60, said flaps 44 are brought into contact respectively with the contact pieces 77 in the cavities 64 for electrical connection between the movable contact springs 41 and the corresponding terminal pins 72. With this arrangement, the pivot arms 43 itself can serve not only as the pivot axis but also as the electrical conductor means or common contacts, which reduces the number of parts employed in the armature unit 40 in addition to that the pivot arms 43 are integrally formed with the movable contact springs 41.

Figure 12:
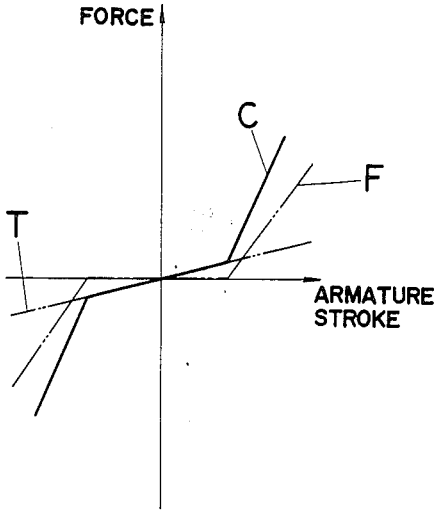
FIG. 12 is a graphical representation of the spring forces acting upon the armature during the stroke of the armature unit.

In the meanwhile, since the pivot arm 43 gives the torsional spring force to the armature 10 in its reversing stroke to either of the set or reset position, it is possible to carry out balancing or tuning of the armature operation to a desired response voltage by adjusting the spring constant thereof such as by selecting the material and/or the configuration of the pivot arms 43. In this connection, the pivot arm 43 extending transversely of the contact spring 41 can have the torsional spring characteristic about its axis, which is substantially independent of the flexing motion along the length of the spring 41 required for providing a suitable contacting pressure. With this result, the adjustments of the response sensitivity and the contact pressure can be carried out independently and separately, despite the fact that the pivot arm 43 is integrally formed with the contact spring 41. The torsional spring force T about the axis of the pivot arm 43, the flexure spring force F along the length of the movable contact spring 41, and the composite force C thereof acting on the armature 10 at a portion spaced from the pivot axis are shown in FIG. 12 to be as the functions of the armature stroke.

Figure 9:
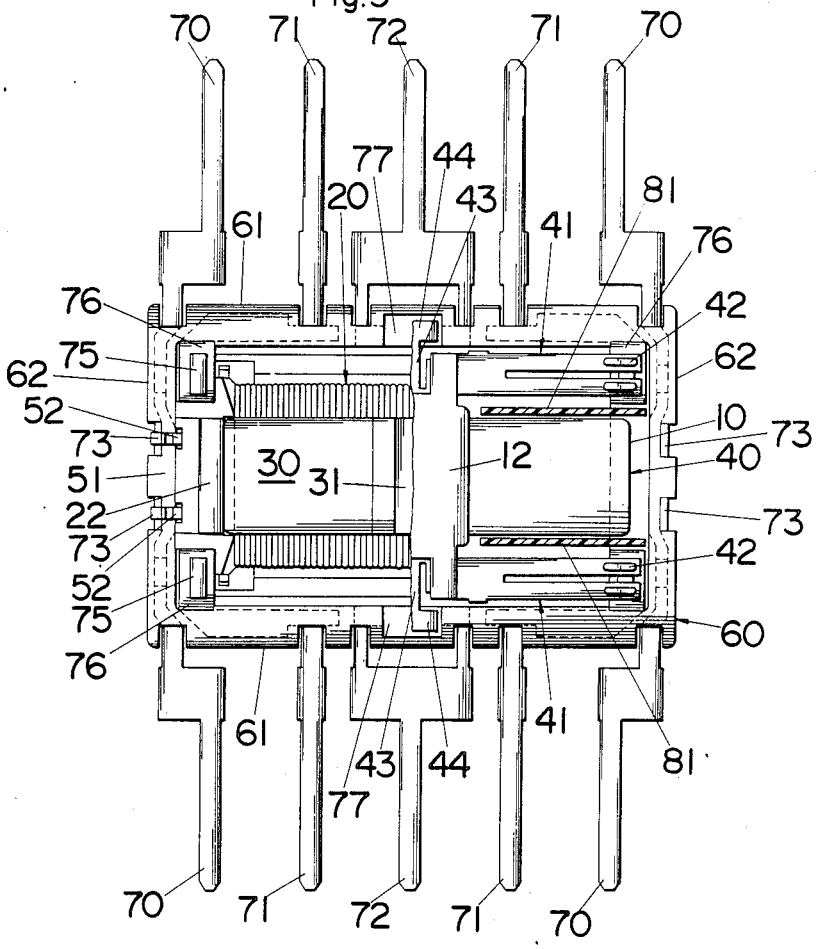
FIG. 9 is a top view partly in cross section of the above relay with its terminal pins extending horizontally in a pre-assembled condition of the relay.
Figure 10:
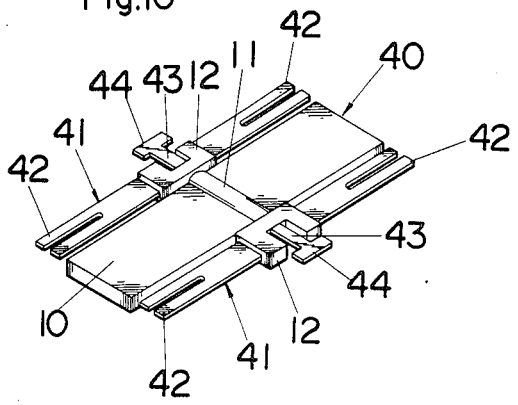
FIG. 10 is a perspective view of the armature unit with the movable contact springs of the above relay as viewed from the underside.

A cover 80 fitted over the casing 60 is provided with a plurality of insulation walls 81 which depend from the top wall to extend into the respective gaps between the armature 10 and the contact ends of each contact springs 41 for effective insulation therebetween, as best shown in FIG. 9.

What is claimed is:

1. A polarized electromagnetic actuator device comprising:

an armature pivotally supported for movement about a pivot axis between two different angularly displaced positions;

an electromagnet having a core, an exciter coil wound only around the core, and a pair of pole members extending from the ends of the core toward the ends of the armature on either side of the pivot axis;

a bar-shaped three-pole magnetized permanent magnet disposed between the free ends of the sole members to extend along the armature in a closely adjacent relationship thereto, said permanent magnet being magnetized to have end poles of the same polarity at its lengthwise ends and to have a center pole of the opposite polarity to the end poles intermediate its ends so as to produce opposing first and second flux paths between the permanent magnet and the armature; said first flux path circulating between the center pole and the one of the end poles through one end portion of the permanent magnet and the adjacent end portion of the armature, and said second flux path circulating between the center pole and the other end pole through the other end portion of the permanent magnet and the adjacent end portion of the armature; said first and second flux paths extending through a common air gap between the permanent magnet and the armature in proximity to the pivot axis; and said center pole being offset from the pivot axis of the armature along the length of the permanent magnet so that said common air gap is correspondingly offset therefrom to thereby produce a torque on the armature tending to rotate the armature about the pivot axis toward the one of the angularly displaced positions.

2. A polarized electromagnet actuator device as set forth in claim 1, wherein the armature is in the form of an elongate flat member and the surface of the permanent magnet confronting the armature is inclined so that the permanent magnet is closer to the armature at the pivot axis than at the longitudinal ends when the armature is in a neutral position where the armature has its longitudinal ends evenly spaced from the adjacent longitudinal ends of the permanent magnet.

3. A polarized electromagnet actuator device as set forth in claim 1, wherein the permanent magnet is made of magnetic material essentially composed of Fe-Cr-Co alloy material.

* * * * *